United States Patent [19]

Nakamae et al.

[11] Patent Number: 4,891,262

[45] Date of Patent: Jan. 2, 1990

[54] HIGH STRENGTH WET-LAID NONWOVEN FABRIC AND PROCESS FOR PRODUCING SAME

[75] Inventors: Kenji Nakamae; Tsukasa Shima, both of Nobeoka, Japan

[73] Assignee: Asahi Kasei Kogyo Kabushiki Kaisha, Japan

[21] Appl. No.: 282,645

[22] Filed: Dec. 12, 1988

[30] Foreign Application Priority Data

Dec. 16, 1987 [JP] Japan ..... 62-316091

[51] Int. Cl.[4] ..... D04H 1/46

[52] U.S. Cl. ..... 428/224; 28/104; 28/105; 428/299

[58] Field of Search ..... 428/224, 299; 28/104, 28/105

[56] References Cited

U.S. PATENT DOCUMENTS 4,152,480 5/1979 Adachi et al. ..... 28/104

*Primary Examiner*—Marion C. McCamish

*Attorney, Agent, or Firm*—Finnegan, Henderson, Farabow, Garrett & Dunner

[57] ABSTRACT

Provided is a high strength wet-laid nonwoven fabric having strength, i.e., tensile strength, tear strength and interlayer peeling strength, similar to those of a filament nonwoven fabric, and a uniformity similar to that of a conventional wet-laid nonwoven fabric. This nonwoven fabric is made of a fiber having a fiber diameter of from 7 μm to 25 μm and a ratio L/D of from $0.8\times10^3$ to $2.0\times10^3$ and is produced by entangling the fibers in a sheet made by a paper making machine by using a columnar water stream.

7 Claims, 1 Drawing Sheet

HIGH STRENGTH WET-LAID NONWOVEN FABRIC AND PROCESS FOR PRODUCING SAME

BACKGROUND OF THE INVENTION (1) Field of the Invention

The present invention relates to a high strength wet-laid nonwoven fabric and a process for producing same. More particularly, the present invention relates to a nonwoven fabric having a high strength, e.g., a high tensile strength, a high tear strength, and a high interlayer peeling strength, and produced by a paper-making method, and a process for producing same.

(2) Description of Related Art

Nonwoven fabrics are now used in various applications and have replaced conventional knitted fabrics and woven fabrics or the like, since nonwoven fabrics have functional applications that can not be achieved by the conventional knitted fabrics and woven fabrics or the like, and the application of the nonwoven fabric has remarkably increased.

Various types of the nonwoven fabrics are known, for example, the following are typical known nonwoven fabrics; dry-laid nonwoven fabrics composed of filaments and obtained by a direct spinning of a fiber formable high polymer by a spunbond process, a flash spinning process or the like, drawing simultaneously spun filaments in the presence of a gas, such as air, and accumulating the obtained filaments. Such nonwoven fabrics are disclosed in Japanese Examined Patent Publication (Kokoku) No. 48-38025 and No. 42-19520, and Japanese Unexamined Patent Publication (Kokai) No. 63-50512. A dry-laid nonwoven fabric composed of staple fibers having a relatively long fiber length and obtained by a melt blowing process is disclosed in Japanese Unexamined Patent Publication (Kokai) No. 49-48921 and U.S. Pat. No. 3,379,811. Dry-laid nonwoven fabrics composed of staple fibers and obtained by opening the staple fibers by a carding process, accumulating the opened staple fibers in a sheet form by using a cross laying machine or an air laying machine, and bonding the staple fibers constituting the sheet to each other by a needle punching process, an entangling process performed by columnar water streams, or an adhering process using an adhesive or heat feasible fibers are disclosed in Japanese Examined Patent Publication (Kokoku) No. 57-58463, U.S. Pat. Nos. 3,403,862 and 3,493,462. Further a nonwoven fabric produced by a paper-making method is well known.

Since fibers constituting the nonwoven fabric in the filament dry-laid nonwoven fabric are filaments, a nonwoven fabric obtained by a heat-press bonding of a web of filaments has a high tensile strength and tear strength, and thus this nonwoven fabric can be widely used as an industrial material for which a high strength is required.

Nevertheless, the interlayer peeling strength of this nonwoven fabric, i.e., the strength required to peel one layer constituting the nonwoven fabric from an adjacent layer is 300 g/cm to 400 g/cm at most and is not sufficient for a product made of the nonwoven fabric. It appears that this inferior interlayer peeling strength prevails because the fibers constituting the nonwoven fabric are filaments, and because the bonding between the filaments is two dimensionally applied by only the heat-press bonding process, and thus there is little entanglement between the filaments. Further, this nonwoven fabric has the following disadvantages. Namely, since a sheet of this nonwoven fabric is formed by applying a drawing and accumulating process using an air stream or a gas stream, the sheet does not have a required uniformity, or a weight per unit area of the sheet is very irregular, and since the bonding between the filaments is obtained by heat-press bonding, the resultant nonwoven fabric has a low elongation, a hard handling, and inferior drape characteristics.

The staple fiber dry-laid nonwoven fabric produced by using a card has less strength than that of the filament dry-laid nonwoven fabric, due to a short length of the fiber used, and when an adhesive or the like is used to provide a stronger bonding of the fibers constituting the nonwoven fabric, and thus increase the strength, a disadvantage arises in that the handling of the nonwoven fabric becomes very hard.

A "spunlaced" nonwoven fabric, i.e., a nonwoven fabric obtained by entangling fibers in a sheet formed by a card, by a water jet without an adhesive, has a soft handling superior to that of the spun bond type nonwoven fabric and a nonwoven fabric obtained by bonding fibers in the sheet formed by the card by using an adhesive or heat fusible fibers. Nevertheless, this nonwoven fabric has disadvantages such that the uniformity of the nonwoven fabric or irregularity of a weight per unit area of the nonwoven fabric is unpreferable due to the use of the card type sheet forming process, in that the interlayer peeling strength of the nonwoven fabric is still too low.

Since a sheet from which the wet-laid nonwoven fabric is made is formed by dispersing fibers having an extremely short length in water, this nonwoven fabric has a remarkable uniformity for superior to that of the dry-laid nonwoven fabric, but since in general, fibers having an extremely short length, e.g., 3 mm to 7 mm, must be used to ensure a uniform dispersion of the fibers in the water, the strength of the nonwoven fabric obtained by this method is very low, and therefore, the application of this nonwoven fabric is limited to fields in which a nonwoven fabric having a high strength is not required. Further, when a paper making machine is used for implementing this method, since the sheet is generally pressed by a dryer equipped with a felt or a yankee machine, a thickness of the wet-laid nonwoven fabric is thin and a density of the fibers in the nonwoven fabric becomes high, and thus the nonwoven fabric has a paper-like handling feel. These properties are typical disadvantages of the known wet-laid nonwoven fabric.

As described above, the conventional nonwoven fabric has advantages and disadvantages, depending upon the producing method used, and a nonwoven fabric having a superior uniformity, a high strength, and a soft handling has not ben produced to date.

SUMMARY OF THE INVENTION

A primary object of the present invention is to provide a novel wet-laid nonwoven fabric having a superior uniformity, which is an essential feature of the conventional wet-laid nonwoven fabric, a higher strength, and an improved handling, to eliminate the disadvantages of the conventional nonwoven fabric.

A second object of the present invention is to provide a process for producing a wet-laid nonwoven fabric having a superior uniformity, a high strength, and a superior handling.

In accordance with the present invention, the first object is realized by a high strength wet-laid nonwoven fabric composed of staple fibers having a single fiber diameter D of from 7 μm to 25 μm and a ratio L/D between a fiber length L and the single fiber diameter D of from $0.8\times10^3$ to $2.0\times10^3$; the stable fibers being entangled in a three-dimensional state.

Preferably, the mean fiber entangling point interval is 300 μm or less.

The second object of the present invention is realized by a novel process for producing the wet-laid nonwoven fabric, wherein a sheet is formed from staple fibers having a single fiber diameter D of from 7 μm to 25 μm and a ratio L/D between a fiber length L and the single fiber diameter D of from $0.8\times10^3$ to $2.0\times10^3$, by a paper making method, and the staple fibers in the obtained sheet are entangled in a three dimensional state by a high speed fluid current treatment.

DESCRIPTION OF THE PREFERABLE EMBODIMENTS

Figure 1:
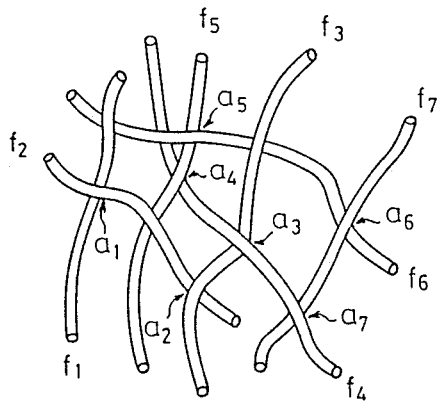
FIG. 1 is an enlarged view of a surface of the nonwoven fabric in accordance with the present invention, illustrating an entangling state of the fibers constituting the nonwoven fabric.

In the wet-laid nonwoven fabric, the nonwoven fabric must be constituted of fibers having a specified shape and the fibers entangled in a three-dimensional state, since this constitution produces a nonwoven fabric having a higher strength than that of the conventional nonwoven fabric.

The fibers constituting the nonwoven fabric must from 7 μm to 25 μm and a ratio L/D between the fiber length L and the single fiber diameter D of from $0.8\times10^3$ to $2.0\times10^3$ When the single fiber diameter is less than 7 μm, even if the ratio L/D of the fiber satisfies the above-mentioned value, the strength of the single fiber is too low, resulting in a lower tensile strength, tear strength and interlayer peeling strength of the obtained nonwoven fabric, and thus it is impossible to achieve the object of the present invention.

When the single fiber diameter is larger than 25 μm, even if the ratio L/D of the fiber satisfies the above-mentioned value, the uniformity and fineness the surface of the nonwoven fabric are lost due to the thickness of the fiber, and thus it is again impossible to achieve the object of the present invention. Therefore, the single fiber diameter must be from 7 μm to 25 μm, from the viewpoint of the strength and uniformity of the surface of the nonwoven fabric, and preferably the single fiber diameter is from 10 μm to 17 μm.

The ratio L/D of from $0.8\times10^3$ to $2.0\times10^3$ is satisfied when the single fiber diameter is within the above-mentioned range, but preferably the ratio L/D is from $1.0\times10^3$ to $1.5\times10^3$. It has been found that the ratio L/D has an important relationship with the obtaining of an easy entangling of the fibers. When the ratio L/D is lower than $0.8\times10^3$ or higher than $2.0\times10^3$, it is impossible to obtain a nonwoven fabric having the required strength. Namely, when the ratio L/D is from $0.8\times10^3$ to $2.0\times10^3$, a nonwoven fabric having a high strength enabling a practical use of the nonwoven fabric is obtained.

The reason for the limitation to the above suitable range of the ratio L/D in the present invention, is estimated as follows.

Namely, movement of the fibers is easier when a water jet stream or the like is applied and the ratio L/D is low, i.e., when the fiber has a relatively thick diameter and a relatively short fiber length, and in this case, the interlacement of the fibers is increased, and the number of contacting points between the fibers is greatly increased when the ratio L/D is high, i.e., when the fiber has a relatively thin diameter and a relatively long length. Nevertheless, when the ratio L/D is too high, the movement of the fibers for entangling the fibers is suppressed, and thus the entanglement of the fibers is reduced. Namely, there is an optimum ratio L/D at which a maximum entangling density of the fibers is obtained, and in the present invention, the above optimum range is from $0.8\times10^3$ to $2.0\times10^3$ as described hereinbefore.

Preferably, the fibers constituting the nonwoven fabric in accordance with the present invention are entangled in a three-dimensional state such that the mean fiber entangling point interval is 300 μm or less.

A fiber having a circular cross section or an irregular cross section can be used for the nonwoven fabric in accordance with the present invention. When the shape of the fiber is circular, the diameter of the fiber can be obtained by a directly measurement thereof, and when the fiber has an irregular cross section, the diameter thereof can be obtained by measuring a fineness, i.e., a denier, of the fiber by a weight measuring method, and calculating a mean diameter from the obtained value of the denier by the following equation.

$$R=\sqrt{\frac{4}{\pi\times9\times10^5\times\rho}}\times\sqrt{d\times10^4}$$

wherein R denotes a mean diameter of a single fiber (μm)

$\rho$ denotes a density of a high polymer constituting the fiber ($g/cm^3$)

d denotes a denier of the single fiber $\pi$ denotes a circular constant

The mean fiber entangling point interval value used in this specification is measured by a method disclosed in U.S. Pat. No. 4,476,186, column 4, lines 20 to 33, as a measure expressing a degree of entangling of the fibers. For example, when the mean length is small, the fibers are densely entangled.

The mean fiber entangling point interval will be explained with reference to the drawing. FIG. 1 is an enlarged view illustrating an arrangement of fibers constituting the wet-laid nonwoven fabric in accordance with the present invention, when the nonwoven fabric is observed from above. In FIG. 1, the fibers constituting the nonwoven fabric are denoted as $f_1$, $f_2$, $f_3$. . ., and a point at which the fiber $f_2$ crosses over the fiber $f_1$ is denoted as $a_1$, and a point at which the fiber $f_2$ first crosses under another fiber, i.e., a fiber $f_3$ in FIG. 1, is denoted as a point $a_2$. Points a , $a_4$. . . are determined in the same way. The distances, in a plane parallel to the nonwoven fabric, between $a_1$ and $a_2$, $a_2$ and $a_3$ . . . are measured, and a mean value is calculated from a plurality of the measured distances as the mean fiber entangling point interval.

As a fiber constituting the wet-laid nonwoven fabric in accordance with the present invention, a polyamide fiber such as Nylon 6, Nylon 66, Nylon 610 or the like, a polyester fiber such as a polyethylene terephthalate, a polybutylene terephthalate or the like, a polyolefin fiber such as a polypropylene, a polyethylene or the like, and a regenerated cellulose fiber such as a rayon or the like, all having a fiber diameter and ratio L/D within the ranges required by the present invention, can be used.

Preferably, the Young's modulus of the fiber is from 50 kg/mm$^2$ to 700 kg/mm$^2$, more preferably, from 50 kg/mm$^2$ to 500 kg/mm$^2$. Since a fiber having a high Young's modulus of, for example more than 700 kg/mm$^2$, has a strong bending rigidity, and a strong entangling force, e.g., a columnar water stream having an extremely high pressure is must be applied to obtain an entangling state of the fibers having a mean fiber entangling point interval of 300 μm or less, a fiber having a Young's modulus of more than 700 kg/mm$^2$ is not suitable for the present invention.

Since the wet-laid nonwoven fabric in accordance with the present invention is constituted as described above, it has a high tensile strength and a high tear strength unobtainable in a conventional wet-laid nonwoven fabric, and has an interlayer peeling strength which is remarkably higher than those obtained in a filament nonwoven fabric such as a spunbond nonwoven fabric or the like, or a nonwoven fabric produced by preparing a web from fibers having a relatively long fiber length, crimping by a card, and entangling the fibers in the web by a columnar water stream, e.g. a spunlaced type nonwoven fabric such as Sontara® supplied from Du Pont de Nemours & Co., Inc. Note, the wet-laid nonwoven fabric in accordance with the present invention has an excellent uniformity since the irregularity of the weight per unit area is small, which is an essential characteristic of the wet-laid nonwoven fabric.

Further, the fibers constituting the wet-laid nonwoven fabric in accordance with the present invention are bonded by only a three dimensional entangling process, and another bonding means such as an adhesive or the like is not used. Therefore, the wet-laid nonwoven fabric in accordance with the present invention has a extremely soft handling and a good drape, compared with a conventional wet-laid nonwoven fabric bonded by an adhesive or the like.

Since the wet-laid nonwoven fabric in accordance with the present invention has excellent characteristics which can not be obtained by the conventional wet-laid nonwoven fabric, this new wet-laid nonwoven fabric can be used in various applications including applications to which the conventional wet-laid nonwoven fabric cannot be applied, for example, medical materials such as surgical packs and gowns, and under pads or the like, and hygienic materials such as diapers, napkins, masks or the like.

The remarkable features of the wet-laid nonwoven fabric in accordance with the present invention when used for a specific application will be explained hereinafter.

Nonwoven fabrics are used for surgical gowns, and since such a gown must have a high liquid barrier property, U.S. Pat. No. 4,442,161, proposed to inject a columnar water stream into a nonwoven sheet prepared by plying a wood pulp composed of fine fibrils on a web of polyester fibers such as polyethylene terephthalate fibers, or mixing the wood pulp with the polyester fibers, to entangle the pulp fibrils, in such a manner that the pulp fibrils are forced into gaps between the polyester fibers with the polyester fibers, to increase the density of the nonwoven fabric.

Since the wet-laid nonwoven fabric in accordance with the present invention is constituted as described above, it is unnecessary to use binder fibers such as the wood pulp used in U.S. Pat. No. 4,442,161 to close the gaps between the fibers constituting the nonwoven fabric. For example, the wet-laid nonwoven fabric produced from a polyester fiber having a denier of 1 d and a fiber length of 12.5 mm in accordance with the present invention has a superior liquid barrier property, and thus the application of a binding treatment becomes unnecessary.

Since the wet-laid nonwoven fabric in accordance with the present invention has a superior uniformity and high strength, including a high interlayer peeling strength, this nonwoven fabric can be suitably used for interlining for apparel. Further, since a strong binding of the fibers constituting the wet-laid nonwoven fabric in accordance with the present invention is obtained by only an entanglement of the fibers without an adhesive, this nonwoven fabric has a superior lint-free property and a soft handling, and thus has a superior wiping property. Therefore this nonwoven fabric can be used for an industrial wiping cloth in the electronics industry or the like. Further, the wet-laid nonwoven fabric in accordance with the present invention can be used for an air filter or a liquid filter: particularly, a prefilter capable of filtering particles having a diameter of from 5 μm to 25 μm, since the property of this nonwoven fabric of a mean fiber entangling point interval of 300 μm or less is particularly suitable for such a filter.

It is known that a nonwoven fabric can be used for a coating base cloth, instead of a base cloth of a woven fabric or a knitted fabric, but since the interlayer peeling strength of the conventional nonwoven fabric is low compared with that of the woven fabric and the knitted fabric, in a coating cloth produced by coating a polyurethane resin or a vinyl chloride resin on a surface of the nonwoven fabric, a layer constituting the nonwoven fabric is easily peeled from adjacent layer of the nonwoven fabric, and thus this coating cloth cannot be used. To solve the above problem, the conventional nonwoven fabric is treated with an elastic polymer such as a polyurethane resin, a polyacrylic ester resin, SBR, MBR, NBR or the like as a binding agent, and then the surface of the conventional nonwoven fabric is coated with a polyurethane resin, a vinyl chloride resin or the like. In this case, however, the handling of the coated nonwoven fabric becomes paper-like, and therefore, the quality of the coated nonwoven fabric is inferior to that of a coated fabric based on the woven fabric or knitted fabric. Since the wet-laid nonwoven fabric in accordance with the present invention has a remarkably high interlayer peeling length, compared with the usual nonwoven fabric, it can be used as a coating base cloth, without a binding agent, and the wet-laid nonwoven fabric in accordance with the present invention can be used for a coating base cloth having a superior soft handling and a high interlayer peeling strength which can not be obtained by the conventional nonwoven fabric.

Further, the wet-laid nonwoven fabric in accordance with the present invention can be used as a base cloth of an artificial leather. For example, a grain-like artificial leather can be obtained by coating a solution or an emulsion of an elastic polymer such as a polyurethane resin, a vinyl chloride resin, SBR, MBR, NBR or the like on a surface of the wet-laid nonwoven fabric in accordance with the present invention by a gravure coater or a doctor knife or the like. In this case, if necessary before coating process, preferably the nonwoven fabric is immersed into a solution of the elastic polymer such as polyurethane resin or the like and the nonwoven fabric then filled with the elastic polymer in a dry state or a wet state to further improve the strength and handling of the obtained artificial leather.

When obtaining a suede-like artificial leather from the wet-laid nonwoven fabric in accordance with the present invention, the nonwoven fabric is plied with a sheet composed of a plurality of extra fine fibers having a fiber fineness of 0.5 d or less, the plied body is subjected to a three-dimensional entangling treatment to form a composite nonwoven fabric, a layer in which the extra fine fibers are entangled is raised, and if necessary, the obtained nonwoven fabric is immersed in an elastic polymer or the like, and is dyed.

A process for producing the high strength wet-laid nonwoven fabric in accordance with the present invention will be explained hereinafter.

First, staple fibers having a specific shape, i.e., a fiber diameter from 7 μm to 25 μm and a ratio L/D from 3 are prepared and a slurry having $0.8\times10^3$ to $2.0\times10^3$ a concentration of from 0.1% to 3% is prepared by dispersing the fibers in water. Preferably, a small amount of a dispersant is added to the slurry. A nonwoven fabric sheet is then produced from the slurry by a paper making machine with a long net or a circular net. The weight per unit area of the nonwoven fabric is kept within a range of from 5 g/m$^2$ to 500 g/m$^2$, depending on the application thereof. Any fiber suitable for the required application of the nonwoven fabric and having a fiber diameter and a ratio L/D values satisfying the conditions defined by the present invention can be optionally used. Further, if necessary, two or three type of fibers can be used as a mixture thereof. The fibers in the obtained sheet are entangled by a high speed fluid stream. Although any fluid, i.e., liquid or gas, can be used for this process, water is most suitable, due to the easy process handling, cost and a high impact energy thereof. The pressure of the water depends on a type of fiber used and the weight per unit area of the nonwoven fabric sheet. For example, to obtain a nonwoven fabric having a mean fiber entangling point interval of 300 μm or less, a water stream having a pressure from 5 kg/cm$^2$ to 200 kg/cm$^2$, preferably from 10 kg/cm$^2$ to 80 kg/cm$^2$ can be used. Where the same type of fiber is used, water having a lower pressure may be used for a nonwoven fabric sheet having a small weight per unit area, and the water having a higher pressure may be used for a nonwoven fabric sheet having a large weight per unit area. Where a weight per unit area of a nonwoven fabric sheet is the same, to obtain a nonwoven fabric having a high strength in accordance with the present invention, a water stream having a high pressure must be applied to a nonwoven fabric sheet composed of fibers having a high Young's modulus. A diameter of a nozzle for injecting the water stream may be from 0.01 mm to 1.0 mm. A locus of the water stream on the nonwoven fabric sheet may be a straight line parallel to a running direction of the sheet or may be a curved line applied by rotating a header to which the nozzle is fixed or by reciprocally moving the header in a direction perpendicular to the running direction of the sheet. A plurality of circular locuses in which each locus is entangled is obtained by repeating the rotational movement of the header against the running sheet. It is preferable to utilize this rotational movement of the header, as it brings the following advantages. Namely, since an injecting area of the water stream from one nozzle against the sheet is enlarged by the above rotational movement of the header, the efficiency of entangling operation performed by the water stream is higher, an irregularity of the locuses of the water stream, which cause a deterioration of the value of a product, becomes invisible, and a ratio between a strength in a lengthwise direction of the nonwoven fabric and a strength in a widthwise direction of the nonwoven sheet is low.

A high speed water stream may be applied only to one side of the nonwoven fabric sheet or applied alternately to both sides of the nonwoven fabric sheet. The number of high speed water stream treatments can be optionally determined to obtain an optimum entangling state.

Typical conditions of a pressure of the water stream capable of obtaining a wet-laid nonwoven fabric having a superior uniformity and a mean fiber entangling point interval of 300 μm or less are, for example, a columnar water stream having a pressure of from 10 kg/cm$^2$ to 40 kg/cm$^2$ may be applied to one side or both sides of a sheet having a relatively small weight per unit area of from 10 g/m$^2$ to 100 g/m$^2$, and a columnar water stream having a pressure from 30 kg/cm$^2$ to 80 kg/cm$^2$ may be applied alternately to both sides of the sheet having a relatively large weight per unit area of from 150 g/m$^2$ to 500 g/m$^2$.

As one aspect of the producing method of the high strength wet-laid nonwoven fabric in accordance with the present invention, a method comprising a first step of entangling a sheet made by a paper making machine by a columnar water stream, a second step of plying the entangled sheet on a coarse wire net having, for example, from 10 mesh to 20 mesh, and a third step of injecting the columnar water stream on to an upper surface of the entangled sheet to obtain a nonwoven fabric having a pattern including a plurality of open holes, which configuration is similar to that of the wire net, can be used. Here, the bulkiness, dimensional stability and stretch modulus of the obtained wet-laid nonwoven fabric are superior to those of a wet-laid nonwoven fabric which the above third step is not applied.

Preferably a surface of the wet-laid nonwoven fabric in accordance with the present invention is shaped in a cool state or a hot state by a engraved or embossed roller. This method can increase the bonding of the fibers in the entangled nonwoven fabric, and thus the strength such as a tensile strength or the like is further improved by this additional treatment. Further, an unexpected effect is obtained in that the dimensional stability of the nonwoven fabric is improved by applying this treatment.

Consequently, the wet-laid nonwoven fabric in accordance with the present invention has high strengths, i.e., tensile strength, tear strength and interlayer peeling strength, similar to those of a filament dry-laid nonwoven fabric, and has a uniformity similar to that of a wet-laid nonwoven fabric. Further, the handling of the wet-laid nonwoven fabric in accordance with the present invention is remarkably soft.

The present invention will be further explained by examples thereof, which in no way limit the present invention, the definitions and measurements of various characteristics as used throughout these examples are as follows.

Tensile strength (kg/cm)

Measured by a strip method in accordance with JIS-L-1096

Tear strength (kg)

Measured by a single tongue method in accordance with JIS-L-1096.

Interlayer peeling strength (g/cm)

Samples of the nonwoven fabric having a length of 13 cm and a width of 2.5 cm were prepared and an adhesive tape, type D3200 supplied by Sony Chemical Co., Ltd., was arranged on each sample, and the sample and the tape pressed at a temperature of 200° C. for 30 sec. under a pressure of 70 kg/cm$^2$, to obtain a combination body in which the sample and the tape are firmly bonded to each other.

A slit was made between the sample and the tape of the combination body, by a knife, and the separated sample and the separated tape are gripped in a chuck of an autograph, respectively.

The moving speed of the chuck of the autograph was 10 cm/min and the chart speed of the autograph was 10 cm/min.

Since the tape was strong, and the sample and the tape were firmly bonded together, when the tape of the combination body was pulled away from the sample combination body, the tape did not break and the adhered face of the tape and the sample were not separated, but instead, the force applied to the combination body peeled a portion of the nonwoven fabric from the other portion of the nonwoven fabric. Accordingly, an interlayer peeling strength of the nonwoven fabric was measured by this method.

Five combination bodies were measured as described above, three maximum values and three minimum values are selected from a stress strain curve of the combination body, and a mean value calculated from these six values. The measurement were made in the lengthwise direction of the nonwoven fabric and the widthwise direction of the nonwoven fabric, in the same manner, and a mean value of the above-mentioned mean values obtained in both direction expressed as an interlayer peeling strength of the nonwoven fabric.

Softness

A 45° cantilever method in accordance with JIS-L-1096 was used, and a mean value of a value in the lengthwise direction and a value in the widthwise direction was expressed as the softness.

Mean Fiber Entangling Point Interval

Distances were measured by a scanning type electronic microscope at a magnification of 100, and the mean fiber entangling point interval expressed as a mean value of 50 measured values.

EXAMPLE 1

A plurality of polyethylene terephthalate (hereinafter referred to as PET) fibers of 1 d corresponding to a fiber diameter of 10 μm were cut to a length of 10 mm, and were dispersed in water to form a slurry having a concentration of 1%. A ratio L/D of this fiber was $10^3$. A sheet having a weight per unit area of 50 g/m$^2$ was produced from the slurry by an inclined type long net paper making machine, and a columnar water stream having a pressure of 30 kg/cm$^2$ was injected from a plurality of nozzles each having a diameter of 0.1 mm, respectively, and arranged in 18 rows with a pitch of 5 mm therebetween to one side of the sheet, to entangle the fibers constituting the sheet. A distance of 30 mm was maintained between the nozzles and the sheet, and a metal net of a stainless steel and having a mesh of 80 was arranged below the sheet as a supporting member. The water passed through the sheet and was sucked through the metal net. The same treatment by the columar water stream was applied to an opposite side of the sheet, and further a columnar water stream having a pressure of 18 kg/cm$^2$ was injected onto both side of the above sheet, respectively, and the sheet then dried. Accordingly, one sample of the wet-laid nonwoven fabric in accordance with the present invention was obtained. A mean fiber entangling point interval of this nonwoven fabric was 70 μm, and the characteristics of the obtained nonwoven fabric were as follows.

| | |
|---|---|
| Tensile strength | |
| Lengthwise direction: | 2.0 kg/cm |
| Widthwise direction: | 1.9 kg/cm |
| Tear strength | |
| Lengthwise direction: | 1.6 kg |
| Widthwise direction: | 1.4 kg |
| Interlayer peeling strength: | 2100 g/m |
| Softness: | 28 mm |

A polyethylene terephthalate filament nonwoven fabric "Asahikasei Spun Bond® E3050" supplied by Asahi Chemical Co., Ltd., produced by a spun bond method and having a weight per unit area of 50 g/m$^2$ was prepared as a comparative example.

The characteristics of this comparative example were as follows

| | |
|---|---|
| Tensile strength | |
| Lengthwise direction: | 2.4 kg/cm |
| Widthwise direction: | 1.0 kg/cm |
| Tear strength | |
| Lengthwise direction: | 1.1 kg |
| Widthwise direction: | 1.2 kg |
| Interlayer peeling strength: | 230 g/cm |
| Softness: | 41 mm |

As can be seen from the above data, although the nonwoven fabric in accordance with the present invention was a wet-laid nonwoven fabric, this nonwoven fabric had a tensile strength and tear strength similar to those of the filament nonwoven fabric, but had a higher interlayer peeling strength than that of the comparative filament nonwoven fabric. Further this nonwoven fabric had an extremely soft handling and a uniformity, i.e., a uniformity of a weight per unit area, similar to that of a comparative wet-laid nonwoven fabric, and it was confirmed that the wet-laid nonwoven fabric had a superior quality compared with the known conventional nonwoven fabrics.

COMPARATIVE EXAMPLE 1

A PET filament of 0.1 d corresponding to a fiber diameter of 3 μm was produced by a direct spinning method and cut to a length of 3 mm. The ratio L/D was $10^3$. In this comparative example 1, the same conditions as in Example 1 were used to make a nonwoven fabric.

A mean fiber entangling point interval of the obtained nonwoven fabric was 36 μm, and the characteristics of the obtained nonwoven fabric were as follows.

| | |
|---|---|
| Tensile strength | |
| Lengthwise direction: | 1.4 kg/cm |
| Widthwise direction: | 1.2 kg/cm |
| Tear strength | |
| Lengthwise direction: | 0.2 kg |

-continued

| | |
|---|---|
| Widthwise direction: 0.2 | kg |
| Interlayer peeling strength: | 910 g/cm |
| Softness: | 24 mm |

Note that the tear strength of this comparative example was remarkably low.

COMPARATIVE EXAMPLE 2

A sheet having a weight per unit area of 50 g/m$^2$ was produced under the same conditions as in Example 1 from 1 denier PET fiber corresponding to a fiber diameter of 10 μm and having a length of 51 mm, by a paper making machine. The ratio L/D of this fiber was $5.1\times10^3$. Many of the fibers in the slurry became entangled with each other and blocks of fibers appeared scattered throughout the slurry, and the dispersion of the fibers in the slurry was poor. The sheet was treated with columnar water streams under the same conditions as in Example 1, except that the pressure of the water stream was 40 kg/cm$^2$ in the first treatment, and 25 kg/cm$^2$ in the second treatment.

A mean fiber entangling point interval of this nonwoven fabric was 330 μm, and the characteristics of the obtained nonwoven fabric were as follows

| | |
|---|---|
| Tensile strength | |
| Lengthwise direction: | 0.8 kg/cm |
| Widthwise direction: | 0.7 kg/cm |
| Tear strength | |
| Lengthwise director: | 3.6 kg |
| Widthwise direction: | 3.4 kg |
| Interlayer peeling strength: | 210 g/cm |
| Softness: | 39 mm |

COMPARATIVE EXAMPLE 3

A sheet having a weight per unit area of 50 g/m$^2$ was produced under the same conditions as in Example 1 from Nylon 6 of 5 denier corresponding to a fiber diameter of 24 μm and having a length of 5 mm, by a paper making machine. The ratio L/D of this fiber was $0.21\times10^3$. The dispersion of the fibers in the slurry was good, and the sheet was treated with columnar water streams under the same conditions as in Example 1.

A mean fiber entangling point interval of this nonwoven fabric was 340 μm, and the characteristics of the obtained nonwoven fabric were as follows.

| | |
|---|---|
| Tensile strength | |
| Lengthwise direction: | 0.4 kg/cm |
| Widthwise direction: | 0.2 kg/cm |
| Tear strength | |
| Lengthwise direction: | 0.8 kg |
| Widthwise direction: | 0.6 kg |
| Interlayer peeling strength: | 195 g/cm |
| Softness: | 43 mm |

COMPARATIVE EXAMPLE 4

A sheet having a weight per unit area of 50 g/m$^2$ was produced under the same conditions as in Example 1 from a polypropylene of 3 denier corresponding to a fiber diameter of 22 μm and having a length of 20 mm and a Young's modulus of 900 kg/cm$^2$, by a paper making machine. The ratio L/D of this fiber was $0.91\times10^3$.

The sheet was treated with columnar water streams under the same conditions as in Example 1.

A mean fiber entangling point interval of this nonwoven fabric was 350 μm, and the characteristics of the obtained nonwoven fabric were as follows

| | |
|---|---|
| Tensile strength | |
| Lengthwise direction: | 0.1 kg/cm |
| Widthwise direction: | 0.09 kg/cm |
| Tear strength | |
| Lengthwise direction: | 0.7 kg |
| Widthwise direction: | 0.3 kg |
| Interlayer peeling strength: | 180 g/cm |
| Softness: | 41 mm |

EXAMPLE 2

A sheet having a weight per unit area of 300 g/m$^2$ was produced under the same conditions as in Example 1 from Nylon 66 of 1.5 denier corresponding to a fiber diameter of 13.1 μm and having a length of 12.5 mm, by a paper making machine. The ratio L/D of this fiber was $0.95\times10^3$.

An apparatus for injecting columnar water streams having a plurality of nozzles each having a diameter of 0.2 mm, respectively, and arranged in 12 rows with a pitch of 5 mm therebetween, and located 30 mm above the sheet, and a supporting members of a metal net of 80 mesh was used. The columnar water stream treatment was applied to one side of the sheet and then applied to an opposite side while the water was sucked through the metal net, and this treatment was repeated twice. The pressure of the water stream was 70 kg/cm$^2$ in the first treatment, and was 50 kg/cm$^2$ in the second treatment. The entangled nonwoven fabric was then dried.

A mean fiber entangling point interval of this nonwoven fabric was 90 μm, and the characteristics of the obtained nonwoven fabric were as follows

| | |
|---|---|
| Tensile Strength | |
| Lengthwise Direction: | 16.1 kg/cm |
| Widthwise Direction: | 15.7 kg/cm |
| Tear Strength | |
| Lengthwise Direction: | 9.7 kg |
| Widthwise Direction | 10.0 kg |
| Interlayer Peeling Strength: | 1900 g/cm |
| Softness: | 74 mm |

Since this nonwoven fabric has a good uniformity, and the tensile strength and the tear strength are nearly the same in the lengthwise direction and in the widthwise direction, this nonwoven fabric can be used for a civil engineering material such as roofing or the like.

EXAMPLE 3

A sheet having a weight per unit area of 40 g/m$^2$ was produced under the same conditions as in Example 1 from a cellulose fiber produced by a viscous method, i.e., a rayon of 1 denier corresponding to a fiber diameter of 9.7 μm and having a length of 15 mm, by a paper making machine. The ratio L/D of this fiber was $1.55\times10^3$.

An apparatus for injecting columnar water streams having a plurality of nozzles each having a diameter of 0.08 mm, respectively, and arranged 10 rows with a pitch of 2 mm therebetween, and on a position upper from the sheet by 50 mm, and a supporting member having a metal net of 60 mesh and supporting the sheet was used. The columnar water stream treatment was applied to one side of the sheet and then applied to an opposite side, and this treatment was repeated three times. The pressure of the water stream was 15 kg/cm$^2$ in the first treatment, 23 kg/cm$^2$ in the second treatment, and 16 kg/cm$^2$ in the third treatment. The entangled nonwoven fabric was then dried.

A mean fiber entangling point interval was 52 μm, and the characteristics of the obtained nonwoven fabric were as follows.

| | |
|---|---|
| Tensile Strength | |
| Lengthwise Direction: | 0.14 kg/cm |
| Widthwise Direction: | 0.10 kg/cm |
| Tear Strength | |
| Lengthwise Direction: | 0.30 kg |
| Widthwise Direction: | 0.25 kg |
| Interlayer Peeling Strength: | 1,020 g/cm |
| Softness: | 26 mm |

A cellulose group filament nonwoven fabric "Bemliese®" supplied by Asahi Chemical Co., Ltd., and having a weight per unit area of 40 g/m$^2$ was prepared as a comparative example.

The characteristics of this comparative example were as follows.

| | |
|---|---|
| Tensile Strength | |
| Lengthwise Direction: | 0.22 kg/cm |
| Widthwise Direction: | 0.03 kg/cm |
| Tear Strength | |
| Lengthwise Direction: | 0.21 kg |
| Widthwise Direction: | 0.24 kg |
| Interlayer Peeling Strength: | 160 g/cm |
| Softness: | 34 mm |

As can be seen from the above data, this nonwoven fabric has nearly the same strengths as those of Bemliese, but has a softer handling than Bemliese.

EXAMPLE 4

A sheet having a weight per unit area of 20 g/m$^2$ was produced under the same conditions as in Example 1 from a PET fiber of 2.0 denier corresponding to a fiber diameter of 14 μm and having a length of 20 mm, by a paper making machine. The ratio L/D of this fiber was $1.42\times10^3$.

A sheet of a wood pulp having a weight per unit area of 30 g/m$^2$ was produced under the same conditions as in Example 1, and this wood pulp sheet was arranged between two PET sheets to form a laminate of the three sheets.

To entangle fibers in the laminated sheet an apparatus for injecting columnar water streams comprising a plurality of nozzles each having a diameter of 0.1 mm, arranged in 15 rows at a pitch of 5 mm and on located 30 mm above the laminated sheet was used. In this case, the header of the nozzles was rotated at 700 r.p.m and the laminated sheet was run at a speed of 6 m/min. The columnar water stream treatment was applied to one side of the sheet and them applied to an opposite side thereof, and this treatment was repeated twice. The pressure of the water stream was 15 kg/cm$^2$ in the first treatment and 28 kg/cm$^2$ in the second treatment.

A mean fiber entangling point interval was 32 μm, and the characteristics of the obtained nonwoven fabric were as follows.

| | |
|---|---|
| Tensile Strength | |
| Lengthwise Direction: | 4.1 kg/cm |
| Widthwise Direction: | 4.0 kg/cm |
| Tear Strength | |
| Lengthwise Direction: | 3.1 kg |
| Widthwise Direction: | 2.9 kg |
| Interlayer Peeling Strength: | 1,300 g/cm |
| Softness | 42 mm |

Since this nonwoven fabric utilizes the hygroscopicity of the pulp, it can be used for disposable wear, e.g., a surgical gown or the like.

EXAMPLE 5

A polypropylene fiber of 1.5 denier corresponding to a fiber diameter of 15.6 μm and having a length of 17.5 mm and a rayon fiber of 1 denier corresponding to a fiber diameter of 9.7 μm and having a length of 12.5 mm, were blended. The ratio L/D of the polypropylene fiber was $1.1\times10^3$ and the ratio L/D of the rayon fiber was $1.3\times10^3$. The blending ratio was 70% of the polypropylene fiber and 30% of the rayon fiber.

A sheet having a weight per unit area of 60 g/m$^2$ was produced under the same conditions as in Example 1, by a paper making machine, and a columnar water stream treatment was applied to the sheet under the same condition as in Example 4.

A mean fiber entangling point interval of this nonwoven fabric was 150 μm, and the characteristics of the obtained nonwoven fabric were as follows.

| | |
|---|---|
| Tensile Strength | |
| Lengthwise Direction: | 3.6 kg/cm |
| Widthwise Direction: | 3.3 kg/cm |
| Tear Strength | |
| Lengthwise Direction: | 2.4 kg |
| Widthwise Direction: | 2.1 kg |
| Interlayer Peeling Strength: | 1,230 g/cm |
| Softness: | 39 mm |

Since this nonwoven fabric utilizes an antistatic property and a hygroscopicity of the cellulose fiber, it can be used as a wiping cloth, or a liner of a floppy disk or the like in the electronics field.

EXAMPLE 6

A sheet having a weight per unit area of 95 g/m$^2$ was produced under the same conditions as in Example 1 from Nylon 66 fiber of 2 denier corresponding to a fiber diameter of 15.1 μm and having a length of 15 mm, by a paper making machine. The ratio L/D of this fiber was $1.0\times10^3$.

A columnar water stream treatment was applied to the sheet under the same conditions as in Example 1, except that the pressure of the water stream was changed to 40 kg/cm$^2$ and the treatment was repeated twice for both sides of the sheet.

A mean fiber entangling point interval of this nonwoven fabric was 93 μm, and the characteristics of the obtained nonwoven fabric were as follows.

| | |
|---|---|
| Tensile Strength | |
| Lengthwise Direction: | 6.3 kg/cm |
| Widthwise Direction: | 5.6 kg/cm |
| Tear Strength | |
| Lengthwise Direction: | 3.5 kg |

-continued

| | |
|---|---|
| Widthwise Direction: | 2.7 kg |
| Interlayer Peeling Strength: | 2100 g/cm |
| Softness: | 37 mm |

A polyurethane was dissolved into a dimethyl formamide an polyether group to form a solution in which the concentration of the polyurethane was 30%. This solution was coated on a surface of the nonwoven fabric by a coating build up to 45 g/m$^2$, by a doctor knife. The coated nonwoven fabric had an extremely soft handling, as it did not include an adhesive. Further extremely fine crepe was formed on a surface of the polyurethane film, and this coated nonwoven fabric had a natural appearance with a high class touch such as given by a grain of a natural leather. Further, since this nonwoven fabric had a sufficiently high interlayer peeling strength, when used as a material such as a chair covering cloth or the like, damage, e.g., peeling of layers constituting the chair covering cloth, was not generating during use of the chair.

EXAMPLE 7

A sheet having a weight per unit area of 300 g/m$^2$ was produced under the same conditions as in Example 1 from Nylon 6 fiber of 1.5 denier corresponding to a fiber diameter of 13.1 μm and having a length of 12.5 mm, by a paper making machine. The ratio L/D of this fiber was $0.95\times10^3$.

To entangle fibers in the sheet, an apparatus for injecting columnar water streams comprising a plurality of nozzles each having a diameter of 0.2 mm, arranged in 18 rows at a pitch of 5 mm and located 30 mm above the sheet was used. In this case, the header of the nozzles was rotated at 150 r.p.m and the sheet was run at a speed of 5 m/min.

A mean fiber entangling point interval was 120 μm, and the characteristics of the obtained nonwoven fabric were as follows.

| | |
|---|---|
| Tensile Strength | |
| Lengthwise Direction: | 18.9 kg/cm |
| Widthwise Direction: | 16.4 kg/cm |
| Tear Strength | |
| Lengthwise Direction: | 13.1 kg |
| Widthwise Direction: | 11.5 kg |
| Interlayer Peeling Strength: | 2210 g/cm |

A polyurethane including a polytetramethylene glycol as a polyol component, a p,p'-diphenylmethane diisocyanate as an isocyanate component, and using an ethylene glycol as a chain extending agent was dissolved in a dimethyl formamide to form a solution having a concentration of the polyurethane of 15%. The nonwoven fabric was immersed in the above solution, was squeezed at a squeezing ratio of 300%, and the polyurethane was then coagulated in water. After drying, a surface of the obtained sheet was buffed by a beltsander equipped with an emery paper of 320 mesh, and then the buffed face of the sheet was pressed by a calender roller having a surface temperature of 150° C. Further, the buffed and pressed surface of the sheet was coated with a 30% solution of the dimethyl formamide including a polybutyleneadipate, p,p'-diphenylmethane diisocyanate, and an ethylene glycol by an engraver roll, the dimethyl formamide was coagulated in water, and then dried. Still further, the engraved surface of the sheet was coated with a 40% solution % of a polyethyleneglycol, the p,p'-diphenyl methane diisocyanate, and an ethylenediamine in a mixed solvent of a methyl ethyl keton and an isopropyl alcohol by an engraver roll, and the solvent was removed at a temperature of 130° C. In the obtained composite sheet material having a grain-like surface, a surface of the covering layer of the polyurethane of the composite sheet material had a superior smoothness, and the composite sheet material per se had a superior softness. The characteristics of the obtained composite sheet material were as follows.

| | |
|---|---|
| Tensile Strength | |
| Lengthwise Direction: | 21.5 kg/cm |
| Widthwise Direction: | 20.6 kg |
| Tear Strength | |
| Lengthwise Direction: | 13.8 kg |
| Widthwise Direction: | 12.1 kg |
| Softness: | 81 mm |

The above-described values of the tensile strength and the tear strength were sufficient to allow this composite sheet material to be used for sport shoes.

EXAMPLE 8

A sheet having a weight per unit area of 200 g/m$^2$ was produced under the same conditions as in Example 1 from Nylon 66 fiber of 1 denier corresponding to a fiber diameter of 10.7 μm and having a length of 10 mm by a paper making machine. A ratio L/D of this fiber was $0.93\times10^3$. Another sheet having a weight per unit area of 70 g/m$^2$ was produced under the same conditions as in Example 1 from PET extra fine fiber produced by a direct spinning method of 0.1 d and having a length of 5 mm, by the paper making machine, and this PET sheet was then plied on the Nylon sheet.

The plied sheets were entangled under the same conditions as in Example 6, by a columnar water stream.

A mean fiber entangling point interval was 93 μm, and the characteristics of the obtained nonwoven fabric were as follows.

| | |
|---|---|
| Tensile Strength | |
| Lengthwise Direction: | 12.6 kg/cm |
| Widthwise Direction: | 10.8 kg/cm |
| Tear Strength | |
| Lengthwise Direction: | 8.9 kg |
| Widthwise Direction: | 8.7 kg |
| Interlayer Peeling Strength: | 1900 g/cm |

A surface of the PET sheet in the piled sheet was buffed by a beltsander equipped with an emery paper of 240 mesh, and this surface was coated with a 20% water solution of a polyvinyl alcohol, which was dissolved in hot water, by a doctor knife and was dried by a hot air. The obtained sheet was immersed in a polyurethane emulsion having a concentration of 1.5% and prepared by dispersing a polyurethane including a polypropylene glycol, an isophorone diisocyanate and an ethylenediamide in water. The water was removed from the sheet by hot air to coagulate the polyurethane, and the polyvinyl alcohol was then removed from the sheet by immersion in hot water at 80° C. The obtained composite sheet material was simultaneously dyed by a circular dyeing machine, and then washed and dried.

The characteristics of the obtained composite sheet material were as follows.

| | |
|---|---|
| Tensile Strength | |
| Lengthwise Direction: | 13.0 kg/cm |
| Widthwise Direction: | 11.3 kg/cm |
| Tear Strength | |
| Lengthwise Direction: | 6.7 kg |
| Widthwise Direction: | 6.0 kg |
| Softness: | 63 mm |

A surface of the PET sheet in the plied sheet, i.e., the composite sheet material, has the appearance of an elegant suede, and the this composite sheet material had a sufficient strength and soft handling and could be used in the apparel and interior decoration fields as a high class suede cloth.

We claim:

1. A high strength wet-laid nonwoven fabric composed of staple fibers having a single fiber diameter D of from 7 μm to 25 μm and a ratio L/D between a fiber length L and the single fiber diameter D of from $0.8\times10^3$ to $2.0\times10^3$, said staple fibers being entangled in a three-dimensioned state.

2. A nonwoven fabric according to claim 1, wherein a mean fiber entangling point interval is 300 μm or the less.

3. A nonwoven fabric according to claim 1, wherein said staple fiber is one or more selected from a group comprising a polyester fiber, a polyamide fiber, a polyacrylic fiber, a polyethylene fiber, a polypropylene fiber and a regenerated fiber.

4. A nonwoven fabric according to claim 1, wherein a Young's modulus of a fiber is from 50 kg/mm$^2$ to 700 kg/mm$^2$.

5. A nonwoven fabric according to any one of claims 1 to 3, wherein an interlayer peeling strength thereof is 1 kg/cm or more.

6. A process for producing a high strength wet-laid nonwoven fabric, wherein a sheet is produced from staple fibers having a single fiber diameter D of from 7 μm to 25 μm and a ratio L/D between a fiber length L and the single fiber diameter D of from $0.8\times10^3$ to $2.0\times10^3$, and said staple fibers in the sheet are entangled in a three-dimensional state by applying a high speed liquid stream to the sheet.

7. A method in according to claim 6 wherein said high speed liquid stream is a columnar water stream and a pressure of the water stream is from 20 kg/cm$^2$ to 200 kg/cm$^2$.

* * * * *